US007112042B2

(12) United States Patent
Tatsumi et al.

(10) Patent No.: US 7,112,042 B2
(45) Date of Patent: Sep. 26, 2006

(54) TURBINE NOZZLE SUPPORT STRUCTURE

(75) Inventors: Tetsuo Tatsumi, Kobe (JP); Yoshihiro Ichikawa, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 188 days.

(21) Appl. No.: 10/969,843

(22) Filed: Oct. 22, 2004

(65) Prior Publication Data

US 2005/0265830 A1 Dec. 1, 2005

(30) Foreign Application Priority Data

May 31, 2004 (JP) ..... 2004-161310

(51) Int. Cl.
*F01D 9/00* (2006.01)

(52) U.S. Cl. ..... 415/191; 415/209.2; 415/209.3; 415/214.1

(58) Field of Classification Search ..... 415/135, 415/138, 139, 189, 191, 190, 209.2, 209.3, 415/214.1

See application file for complete search history.

(56) References Cited

U.S. PATENT DOCUMENTS 4,119,389 A * 10/1978 Gee ..... 415/189
6,164,903 A * 12/2000 Kouris ..... 415/135
6,464,457 B1 10/2002 Morgan et al.

FOREIGN PATENT DOCUMENTS

JP A 2001-317577 11/2001

* cited by examiner

*Primary Examiner*—Edward K. Look
*Assistant Examiner*—Dwayne J White
(74) *Attorney, Agent, or Firm*—Oliff & Berridge, PLC

(57) ABSTRACT

A turbine nozzle support structure supports a ceramic turbine nozzle provided with a flange and disposed at the inlet of a turbine on a nozzle support. Force-multiplying mechanism presses the flange of the turbine nozzle against a nozzle support to support the turbine nozzle on the nozzle support. The force-multiplying mechanisms includes a pressing member having a spring holding part, a fulcrum part and a pressing part, a spring for applying resilient force to the spring holding part, and a fulcrum supporting member having a bearing part for supporting the fulcrum part.

7 Claims, 6 Drawing Sheets

TURBINE NOZZLE SUPPORT STRUCTURE

BACKGROUND OF THE INVENTION

1. Field of the Invention

The present invention relates to a turbine nozzle support structure for supporting the ceramic turbine nozzle of a gas turbine by pressing the turbine nozzle against a nozzle support.

2. Description of the Related Art

Increase of turbine nozzle outlet temperature, namely, turbine inlet temperature, in a gas turbine is effective in improving the efficiency of the gas turbine. A single metal blade or a segment blade formed by integrally combining a plurality of metal blades is used generally as a turbine nozzle for conventional medium and large gas turbines. Since the heat resistance capacity of the metal turbine nozzle limits the increase of the turbine inlet temperature, the turbine nozzle is cooled by compressed air produced by the gas turbine. The compressed air used for cooling the turbine nozzle does not contribute to the combustion of the gas, but decreases the gas temperature after combustion.

Consequently, the combustor outlet temperature needs to be further increased to maintain a predetermined turbine inlet temperature. The increase of the combustor outlet temperature increases $NO_x$ produced by combustion. The nozzle blade needs to be provided with a complicated cooling structure and to be formed of a heat-resistant material by precision casting. Therefore, the nozzle blade is expensive and is subject to deterioration due to oxidation and corrosion at high temperatures and is liable to be abraded due to decrease in hardness.

Application of ceramic materials resistant to oxidation, corrosion and abrasion at elevated temperatures to parts, which are exposed to high temperatures, of combustors and turbines has been tried in an attempt to solve those problems in increasing turbine inlet temperature. Gas turbines provided with ceramic parts to be exposed to elevated temperatures, as compared with turbines provided with metal parts to be exposed to elevated temperatures, are able to operate at higher turbine inlet temperatures without requiring cooling or using reduced cooling air, and are able to operate at higher efficiency, cause less environmental pollution, and have longer effective life.

However, ceramic materials, as compared with metals, are brittle and less elastic. If a ceramic part interferes with an adjacent metal part, the ceramic parts will be easily damaged and therefore considerable contrivance is needed to apply ceramic materials to the parts of combustors and turbines. Some medium and large gas turbines are provided with a turbine nozzle having a plurality of ceramic nozzle segments arranged in a circumferential arrangement to solve problems resulting from increase in thermal stress due to increase in their dimensions and problems related with manufacturing techniques. A support structure disclosed in JP-A 2001-317577 for supporting such nozzle segments presses the nozzle segments against support members with coil springs to absorb the difference in thermal expansion between the ceramic nozzle segments and the adjacent metal support members by the coil springs to prevent troubles due to the respective different modes of deformation of the ceramic nozzle segments and the metal support members.

However, only a limited space is available for installing a mechanism for holding the nozzle segments and hence the coil springs must be small. The holding capacity of the small coil springs is insufficient for holding the turbine nozzle consisting of the nozzle segments.

SUMMARY OF THE INVENTION

The present invention has been made in view of the foregoing problems and it is therefore an object of the present invention to provide a turbine nozzle support structure capable of being installed in an narrow space and of stably supporting a ceramic turbine nozzle by applying a high pressure to the ceramic turbine nozzle to press the ceramic turbine nozzle firmly against a nozzle support.

A turbine nozzle support structure according to the present invention for supporting a ceramic turbine nozzle disposed at an inlet of a turbine on a nozzle support includes: a radially protruding flange formed on the turbine nozzle; and a force-multiplying mechanism configured to press the flange against the nozzle support, the force-multiplying mechanism including a pressing member having a spring holding part, a fulcrum part and a pressing part, a spring for applying resilient force to the spring holding part, and a fulcrum supporting member having a bearing part for supporting the fulcrum part.

The force-multiplying mechanism of the turbine nozzle support structure produces a high pressure by multiplying the resilient force of the spring by the ratio of the distance between a point of action of the resilience of the spring on the spring bearing and the fulcrum part to the distance between the supporting point and the pressing part, and presses the flange of the turbine nozzle firmly against the nozzle support by the high pressure. Therefore, the turbine nozzle can be stably supported on the nozzle support by the resilient force of the small spring that can be disposed in a narrow space. Since the turbine nozzle is formed of a ceramic material excellent in heat resistance, a high turbine inlet temperature can be used to operate the gas turbine at high efficiency, to prevent environmental pollution and to extend the life of the gas turbine. Since the difference in thermal expansion between the ceramic turbine nozzle and the adjacent metal support members is absorbed by the spring, the ceramic turbine nozzle is supported axially elastically, and the ceramic turbine nozzle and the metal support member are supported individually, the ceramic turbine nozzle is affected scarcely by the deformation of the metal support member, and the ceramic turbine nozzle is prevented from damaging due to the unconformity of its deformation with that of the metal support member.

Preferably, in the turbine nozzle support structure according to the present invention, the turbine nozzle is divided circumferentially into a plurality of nozzle segments, and each of the nozzle segments is provided with the force-multiplying mechanism. Since the turbine nozzle is a split segment structure, the turbine nozzle can be employed in medium or large gas turbines in which the use of a monolithic turbine nozzle is difficult due to problems related with thermal stress and manufacturing techniques. The plurality of nozzle segments can be individually stably supported on the nozzle support by the force-multiplying mechanisms.

In the turbine nozzle support structure according to the present invention, it is preferable that an adapter provided with positioning cuts for determining the circumferential positions of the nozzle segments is attached to the nozzle support when the turbine nozzle consists of the plurality of circumferentially separated nozzle segments. The nozzle segments can be positioned with respect to a circumferential direction by engaging the flanges with the cuts.

In the turbine nozzle support structure according to the present invention, it is preferable that either the fulcrum part of the pressing member or the bearing part of the fulcrum supporting member has a spheroidal surface, and the fulcrum part of the pressing member is in point contact with the bearing part of the fulcrum supporting member. Thus, the area of contact between the fulcrum part and the fulcrum supporting member is greater than the area of point contact between a simple spherical surface and a plane, and the degree of freedom of motion of the fulcrum part relative to the fulcrum supporting member is larger than that of members in line-contact with each other. Therefore, the fulcrum part is able to move smoothly on the bearing part of the fulcrum supporting member, the resilient force of the spring can be effectively and surely transmitted to the turbine nozzle by the turning pressing member. Even if the pressing member and the fulcrum supporting member are manufactured in a low machining accuracy and are assembled in a low assembling accuracy, the support part of the slightly tilted pressing member can be brought into contact with the fulcrum supporting member at a predetermined position without trouble.

In the turbine nozzle support structure according to the present invention, it is preferable that the pressing member is in line contact with the flange of the turbine nozzle. Thus, even if the pressing member is tilted from a normal position, the pressing member in line contact instead of surface contact with the flange will not come into partial contact at the edges with the flange and the point of action of force will not be dislocated and hence the turbine nozzle can be stably pressed against the nozzle support.

In the turbine nozzle support structure according to the present invention, it is preferable that the nozzle support is provided with an air passage for guiding compressed air supplied from a compressor included in the gas turbine into the force-multiplying mechanisms. Even if a high turbine inlet temperature is used because the ceramic turbine nozzle is used, the pressing member, the spring and the fulcrum supporting member, which are formed of metals, of the force-multiplying mechanisms can be effectively cooled by the compressed air.

In the turbine nozzle support structure according to the present invention, it is preferable that a heat insulator is interposed between the force-multiplying mechanism and the turbine nozzle. Even if a high turbine inlet temperature is used because the ceramic turbine nozzle is used, the pressing member, the spring and the fulcrum supporting member, which are formed of metals, of the force-multiplying mechanism can be effective shielded from heat radiated from the turbine nozzle by the simple heat insulator.

The turbine nozzle support structure of the present invention produces a high pressure by multiplying the resilient force of the spring by the force-multiplying mechanism and presses the flange of the turbine nozzle against the nozzle support by the high pressure. Even though the turbine nozzle support structure capable of being installed in a narrow space is small, the turbine nozzle support structure is able to support the turbine nozzle stably. Since the turbine nozzle is formed of a ceramic material, a high turbine inlet temperature can be used. Consequently, the gas turbine operates at high efficiency, does not cause environmental pollution and has an extended effective life, and the ceramic turbine nozzle can be prevented from being damaged due to the difference in deformation between the ceramic turbine nozzle and the adjacent metal support member.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
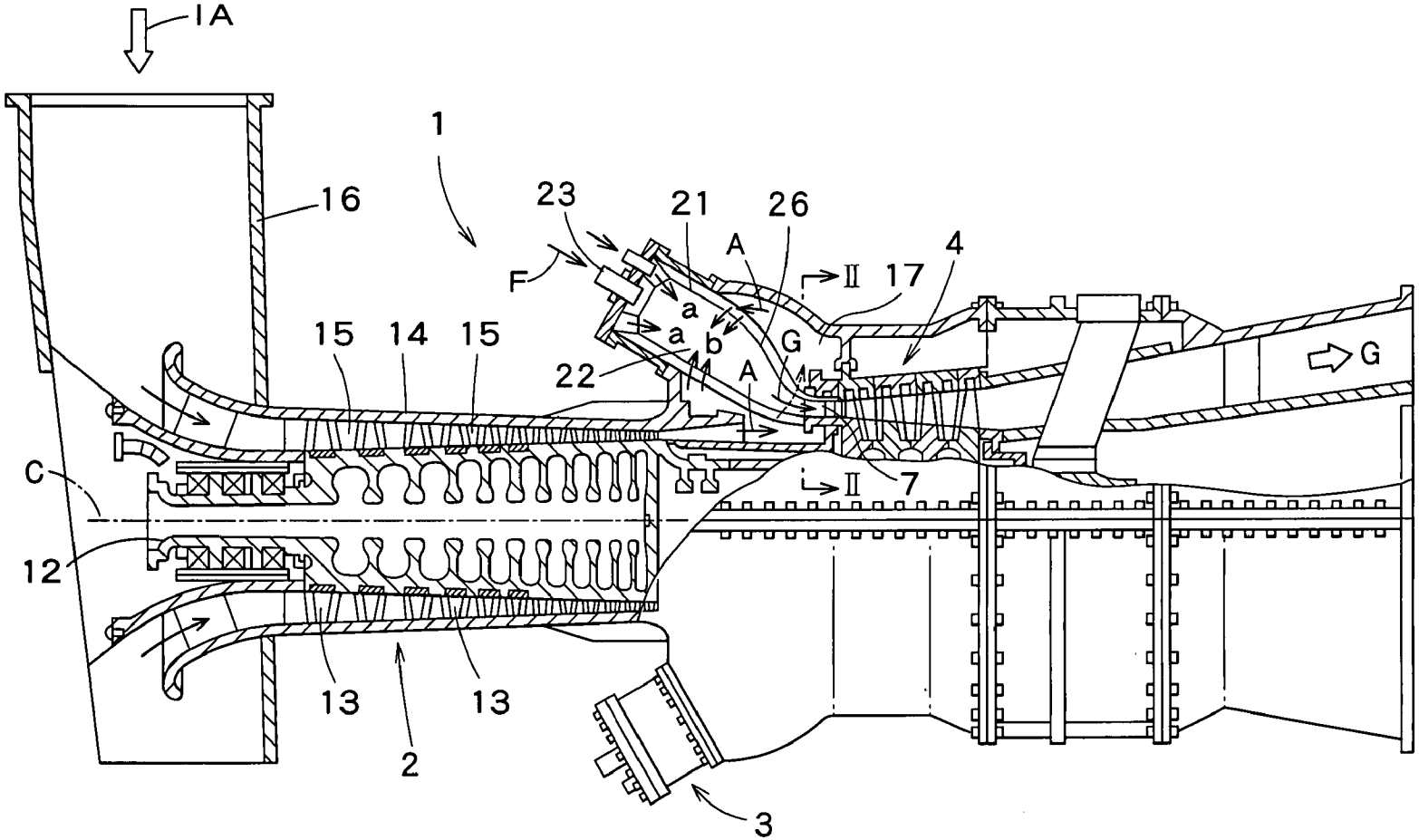
FIG. 1 is a partially cutaway side elevation of a gas turbine provided with a turbine nozzle support structure in a preferred embodiment according to the present invention.

Referring to FIG. 1, the gas turbine 1 has a compressor 2 and a plurality of combustors 3 (six combustors 3 in this embodiment). The compressor 2 compresses air IA to supply compressed air A into the combustors 3. Fuel F, such as a gas fuel or a liquid fuel, is injected into the combustors 3. A turbine 4 is driven by a high-temperature high-pressure combustion gas G produced by burning the fuel F in the combustors 3. The turbine drives the compressor 2 and a load, such as a generator, not shown.

The compressor 2 of the gas turbine 1 is an axial-flow compressor by way of example. The axial-flow compressor 2 includes a rotating shaft 12 provided with a plurality of rotor blades 13 on its circumference, a housing 14, and stationary blades 15 arranged in a plurality of stages on the inner circumference of the housing 14. The air IA sucked through a duct 16 is compressed by the cooperative agency of the rotor blades 13 and the stationary blade 15 to supply the compressed air A into an annular wheel chamber 17.

The six combustors 3 are arranged at equal angular intervals around the wheel chamber 17. The compressed air A flows from the wheel chamber 17 into a combustion chamber 22 defined by a combustion tube 21 of each combustor 3 as indicated by the arrows a and b. Each combustor 3 is provided with a fuel nozzle 23 that injects the fuel F into the combustion chamber 22. The fuel F is mixed with the compressed air A and burns. The high-temperature high-pressure combustion gas G produced by the combustion of the fuel F flows through a transition duct 26 extending downstream with respect to the flowing direction of the combustion gas G from the combustion tube 21 and flows through a turbine nozzle 7 into the turbine 4.

Figure 2:
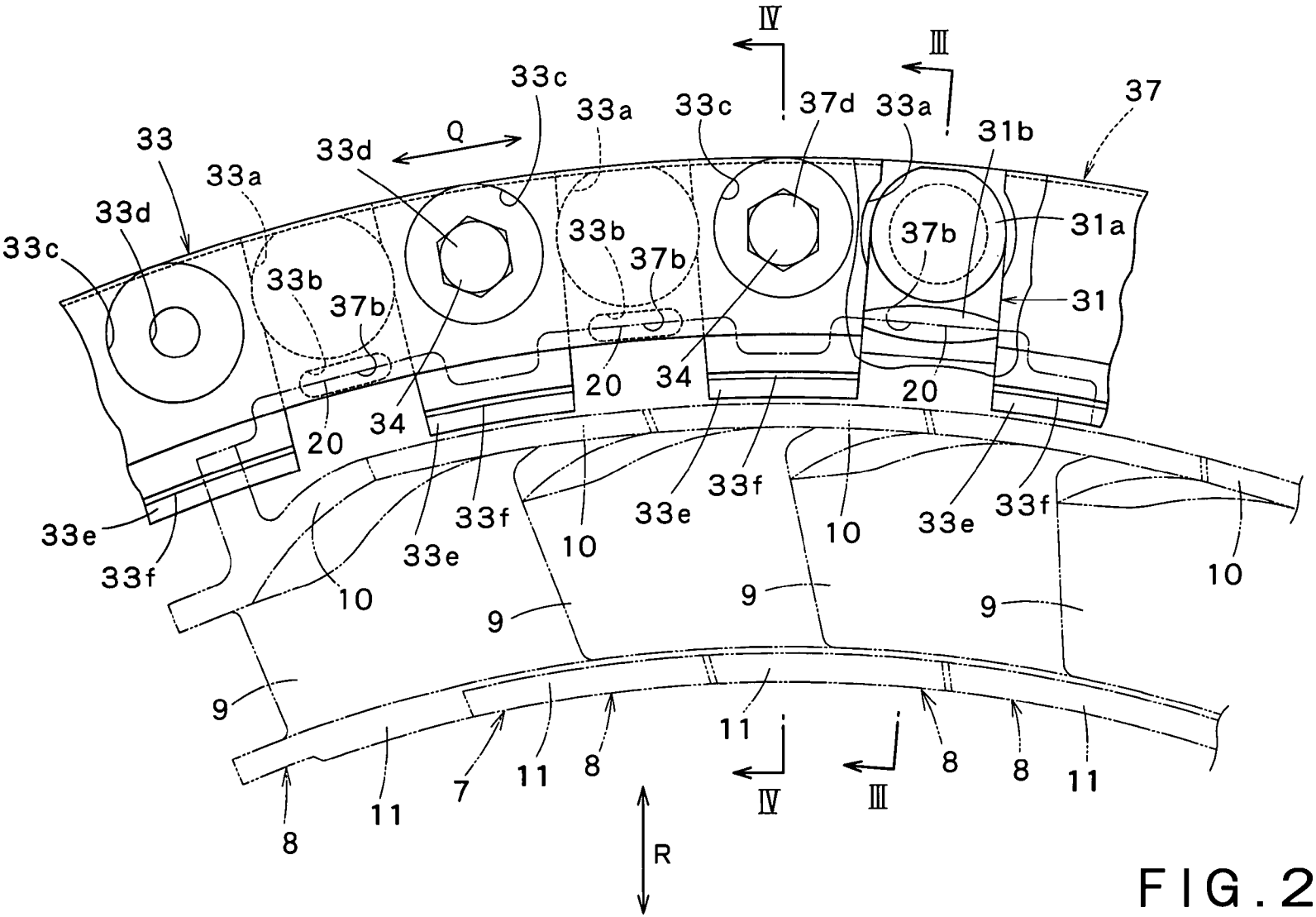
FIG. 2 is an enlarged, fragmentary sectional view taken on the line II—II in FIG. 1.
Figure 5:
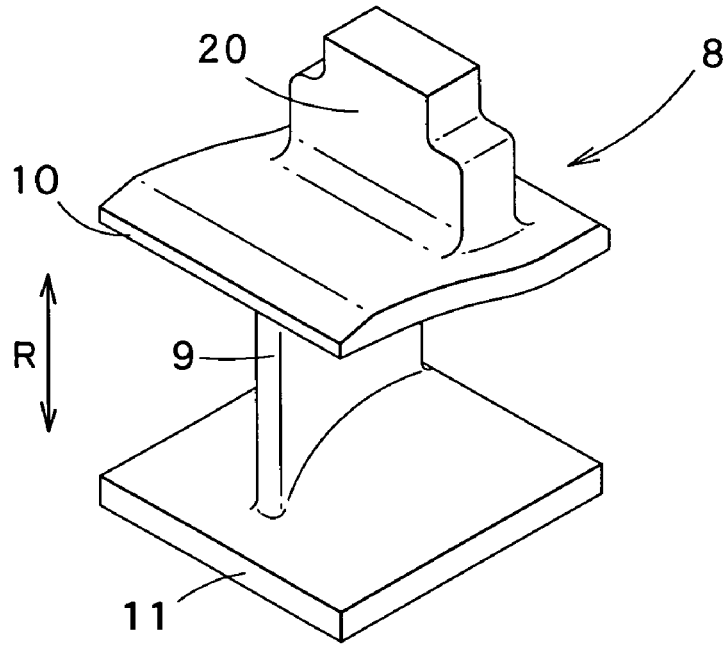
FIG. 5 is a perspective view of a nozzle segment included in the turbine nozzle.

Referring to FIG. 2 showing the turbine nozzle 7 in an enlarged, fragmentary sectional view taken on the line II—II in FIG. 1, the turbine nozzle 7 indicated by two-dot chain lines is a ring formed by arranging a plurality of ceramic nozzle segments 8 (thirty-six ceramic nozzle segments 8 in this embodiment) along the circumferential direction Q. The adjacent ceramic nozzle segments 8 are connected by a known connecting structure. The turbine nozzle 7 is disposed on the inlet side of the first stage rotor blades of the turbine 4 shown in FIG. 1. As shown in FIG. 5, each of the nozzle segments 8 shown in FIG. 2 has a blade part 9, an outer wall 10 formed integrally with the radially outer end of the blade part 9, an inner wall 11 formed integrally with the radially inner end of the blade part 9, and a flange 20 formed integrally with the outer wall 10 so as to protrude in an outward radial direction R. Each nozzle segment 8 is held in place with the flange 20 protruding from the outer wall 10 thereof pressed against a nozzle support. A support structure for supporting the inner wall 11 will be described later.

The turbine nozzle support structure for supporting the turbine nozzle 7 will be described with reference to FIG. 3, i.e., a sectional view taken on the line III—III in FIG. 2. A nozzle support 27 formed of a metal for supporting the turbine nozzle 7 is radially divided into two parts. A support member 28 formed of a metal for holding the transition duct 26 is fastened to the nozzle support 27 with bolts 29. The turbine nozzle 7 consisting of the nozzle segments 8 is disposed opposite to the outlet end of the transition duct 26. Thirty-six force-multiplying mechanisms 30 press the flanges 20 of the thirty-six nozzle segments 8 against the support member 28, respectively. The flanges 20 are pressed elastically against the nozzle support 27 such that the nozzle segments 8 are movable along the axis P of the gas turbine 1. Each force-multiplying mechanism 30 includes a pressing member 31, a spring 32 and a fulcrum supporting member 33. The pressing member 31, the spring 32 and the fulcrum supporting member 33 are metal members. The force-multiplying mechanisms 30 are linked with the nozzle segments 8, respectively.

Figure 6:
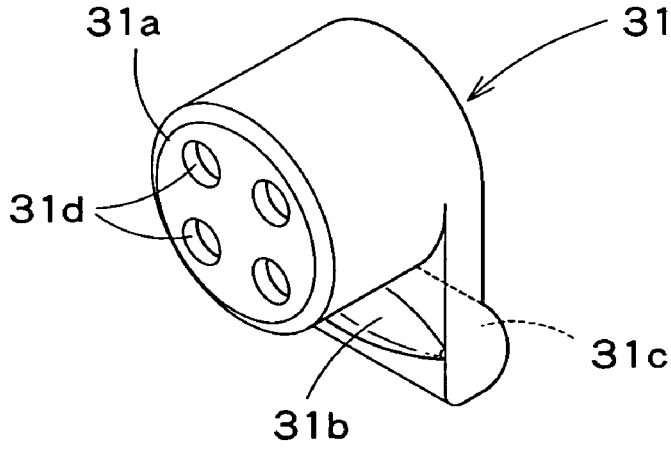
FIG. 6 is a perspective view of a pressing member included in the turbine nozzle support structure shown in FIG. 1.

The pressing member 31 has a spring holding part 31*a* holing the spring 32, a fulcrum part 31*b* in contact with the fulcrum supporting member 33, and a pressing part 31*c* for pressing the flange 20 of the nozzle segment 8 against the nozzle support 27. As shown in FIG. 6, the spring holding part 31*a* is provided with four cooling air outlets 31*d* opening toward the fulcrum supporting member 33. The fulcrum part 31*b* and the pressing part 31*c* will be described later. As shown in FIG. 3, the spring 32 is a coil spring. The spring 32 is held in the spring holding part 31*a* together with a spring bearing member 38. The spring bearing member 38 is provided with a spherical load bearing part protruding from a central part thereof. The resilient force of the spring 32 is concentrated substantially at a single point in a portion, corresponding to the load bearing part, of the spring holding part 31*a*.

Figure 7:
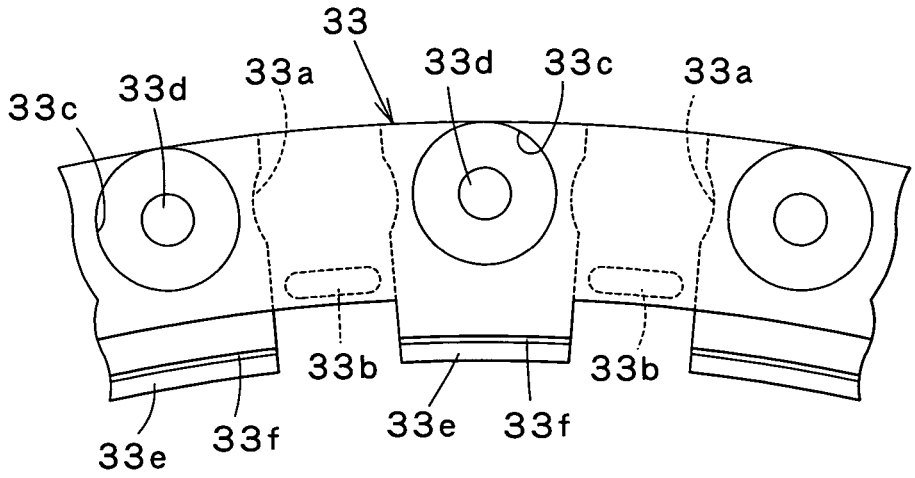
FIG. 7 is a front elevation of a fulcrum supporting member included in the turbine nozzle support structure shown in FIG. 1.

Referring to FIG. 2, the annular fulcrum supporting member 33 is split into two equal semicircular segments. A plurality of recesses 33*a* (thirty-six recesses 33*a* in this embodiment) respectively for receiving the pressing members 31 are formed at equal angular intervals in the rear surface (back surface as viewed in FIG. 2) of the fulcrum supporting member 33. As best shown in FIG. 7, grooves (bearing parts) 33*b* having the shape of a part of a cylindrical wall are formed in the fulcrum supporting member 33. The grooves 33*b* are arranged at angular intervals at positions spaced a distance apart in the inward radial direction R from the recesses 33*a* so as to correspond to the recesses 33*a*, respectively. Circular recesses 33*c* are formed in the surface, opposite the surface in which the recesses 33*a* are formed, of the fulcrum supporting member 33 in portions between the adjacent recesses 33*a*, respectively. Through holes 33*d* are formed in central portions of the circular recesses 33*c*, respectively.

Figure 4:
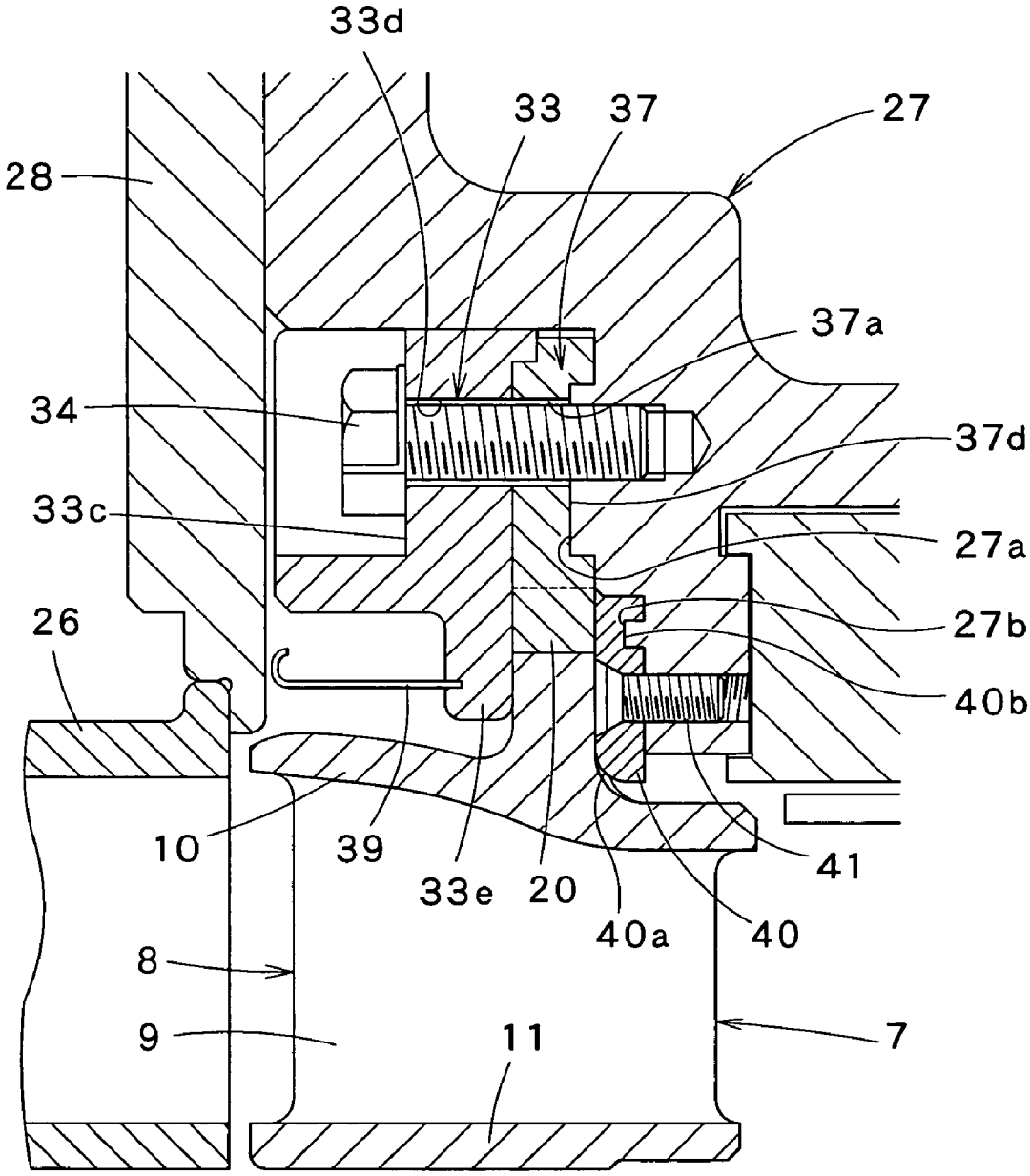
FIG. 4 is a sectional view taken on the line IV—IV in FIG. 2.

Referring to FIG. 4, an adapter 37 is joined to the back surface of the fulcrum supporting member 33. Bolts 34 are passed from the side of the circular recesses 33*c* through the through holes 33*d* and through holes 37*a* formed in the adapter 37 and are screwed in threaded holes formed in the nozzle support 27 to fix the fulcrum supporting member 33 and the adapter 37 to the nozzle support 27.

As shown in FIG. 2, support members 33*e* are formed integrally with the fulcrum supporting member 33. The support members 33*e* protrude in the inward radial direction R from the inner surfaces of potions between the adjacent grooves 33*b* so as to correspond to the circular recesses 33*c*, respectively. Each of the support members 33*e* is provided with a circumferential narrow groove 33*f*. As shown in FIG. 4, a heat insulator 39 divided into two parts is fixedly fitted in the narrow grooves 33*f* of the support members 33*e*. The heat insulator 39 isolates the force-multiplying mechanisms 30 from the turbine nozzle 7.

Figure 8:
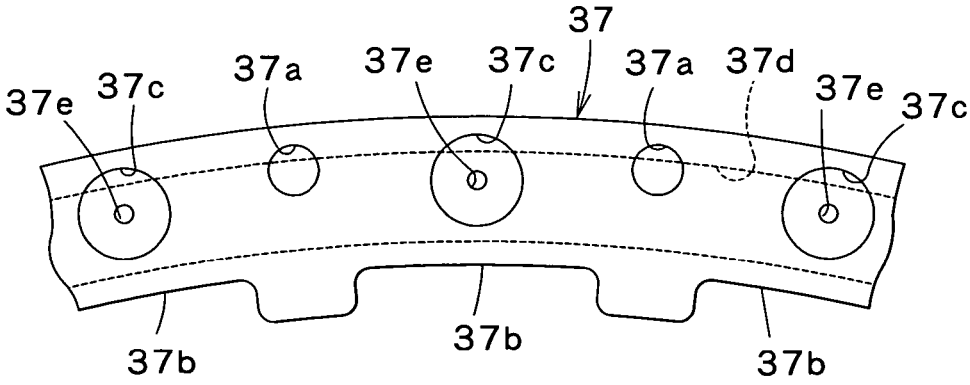
FIG. 8 is a front elevation of an adapter included in the turbine nozzle support structure shown in FIG. 1.

Referring to FIG. 8, the substantially annular adapter 37 is divided into two substantially semicircular parts. Recesses 37*b* are formed in the inner circumference of the adapter 37 at angular intervals. The flanges 20 of the nozzle segments 8 shown in FIG. 2 are engaged in the recesses 37*b*, respectively. Thus the position of the nozzle segments 8 with respect to the circumferential direction are determined, and the nozzle segments 8 are able to move along the axis P of the gas turbine 1 in which the combustion gas G flows as shown in FIG. 3.

As shown in FIG. 8, recesses 37*c* respectively for receiving the springs 32 are formed in the front surface, as viewed in FIG. 8, of the adapter 37, and an annular groove 37*d* is formed in the back surface, as viewed in FIG. 8, of the adapter 37. Air passages 37*e* are formed in central parts of the recesses 37*c*, respectively. As shown in FIG. 3, the adapter 37 is joined to the nozzle support 27 so that an annular protrusion 27*a* formed in the nozzle support 27 is engaged in the annular groove 37*d* of the adapter 37 and is fastened to the nozzle support 27 with the bolts 34. Thus the adapter 37 is able to deform according to the thermal deformation of the nozzle support 27.

Each spring 32 is held in a space extending between the spring holding part 31*a* of the pressing member 31 and the recess 37*c* of the adapter 37. The resilient force of the spring 32 is applied through the spring bearing member 38 to the pressing member 31. The resilient force of the spring 32 exerted on the spring holding part 31*a* produces a torque that turns the pressing member 31 on the fulcrum part 31*b* received in the groove 33*b* of the fulcrum supporting member 33. Consequently, the pressing part 31*c* having the shape of a cylindrical surface is pressed against and held in line contact with the flat surface of the flange 20 of the nozzle segment 8.

The fulcrum part 31*b* of the pressing member 31 in contact with the bottom surface of the groove 33*b* of the fulcrum supporting member 33 is a protrusion having a substantially elliptic shape in a front elevation as shown in FIG. 2. The fulcrum part 31*b* has a spheroidal surface. The groove 33*b* of the fulcrum supporting member 33 in which the fulcrum part 31*b* is received has the shape of a part of a concave cylinder. Thus, the fulcrum part 31*b* is in point contact with the bottom of the groove 33*b*.

Figure 9:
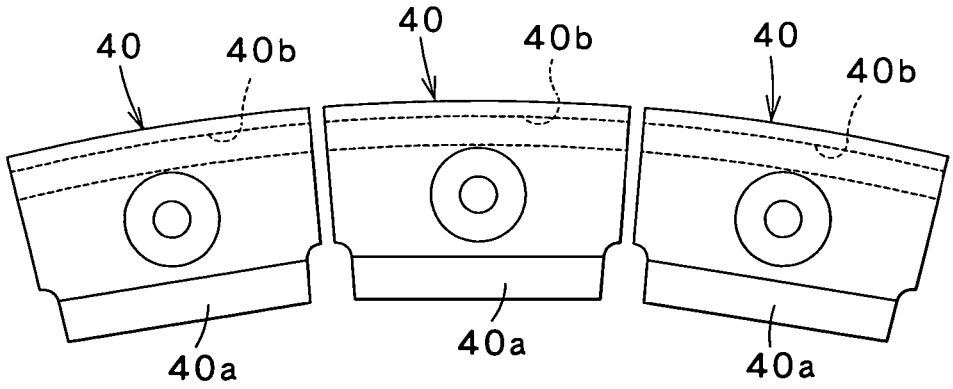
FIG. 9 is a front elevation of a pressure bearing plate included in the turbine nozzle support structure shown in FIG. 1.

Pressure bearing plates 40 are embedded in parts, opposed respectively to the flanges 20 of the nozzle segments 8, of the nozzle support 27. The surfaces of the pressure bearing plates 40 embedded in the nozzle support 27 are flush with the surface of the nozzle support 27. The pressure bearing members 40 are fastened to the nozzle support 27 with bolts 41. The nozzle segment 8 is able to turn in opposite directions on the rounded lower edge 40*a* of the pressure bearing member 40. As shown in FIG. 9, the rounded lower edges 40*a* of all the pressure bearing plates 40 embedded in the nozzle support 27 extend on the sides of a regular polygon, i.e., a thirty-six-sided regular polygon in this embodiment. Thus the flanges 20 of the nozzle segments 8 are kept in line-contact with the rounded inner edges 40*a*, respectively, even if the nozzle segments 8 are inclined. The pressure bearing plates 40 are attached to the nozzle support 27 by a connecting structure similar to that connecting the adapter 37 to the nozzle support 27. The pressure bearing plates 40 are joined to the nozzle support 27 so that an annular protrusion 27*b* formed in the nozzle support 27 is engaged in the annular grooves 40*b* of the pressure bearing plates 40 and are fastened to the nozzle support 27 with the bolts 41.

Figure 3:
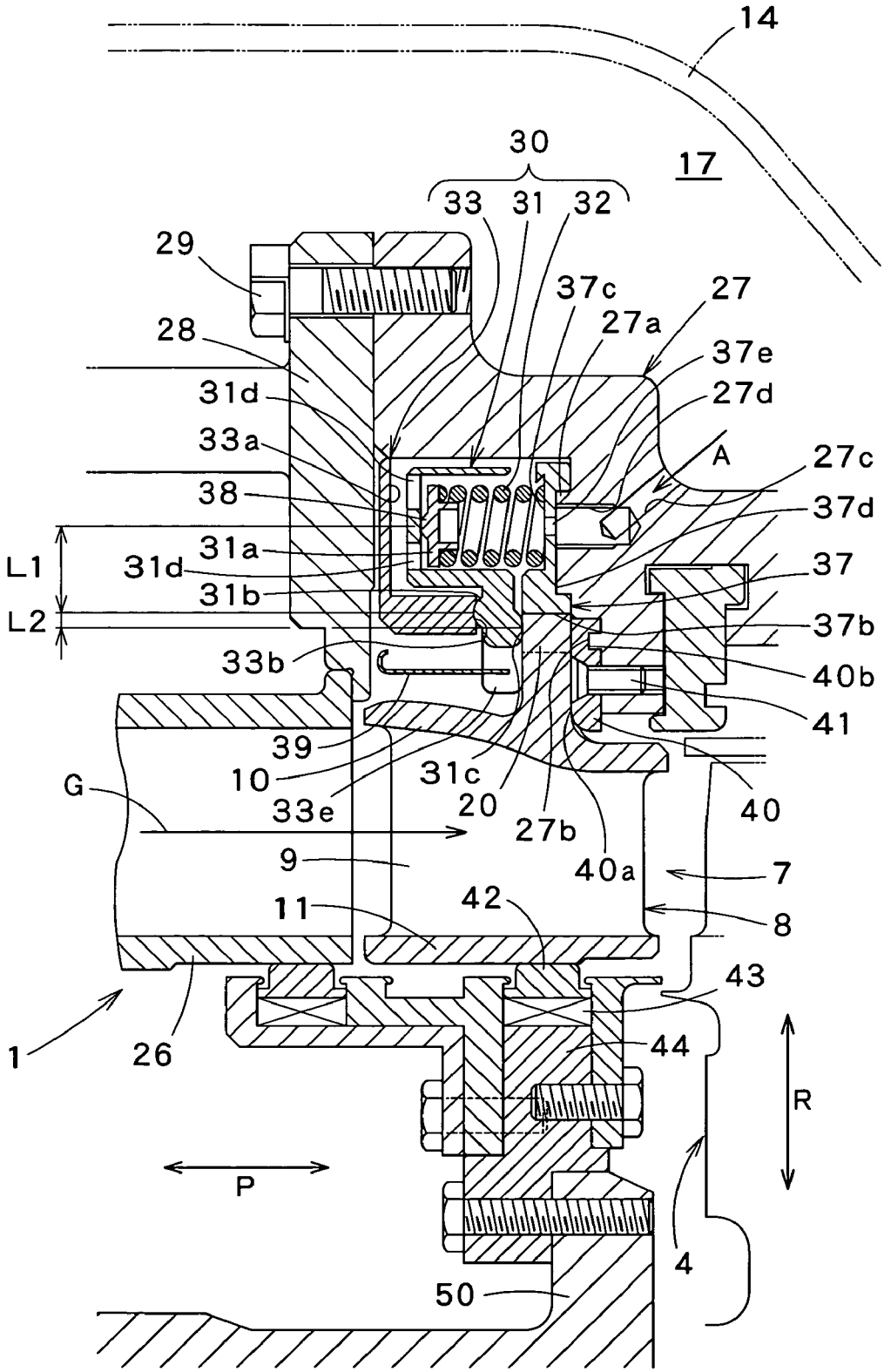
FIG. 3 is a sectional view taken on the line III—III in FIG. 2.

As shown in FIG. 3, the inner wall 11 of each nozzle segment 8 is supported by a ceramic sealing ring 42 and a ceramic spring 43 on a spring support member 44 formed of a metal and fixed to an inner housing 50. The spring support member 44 has the shape of a ring having its center on the axis C of the turbine (FIG. 1). The ceramic sealing ring 42 is divided circumferentially into a plurality of circular segments. The ceramic spring 43 is formed of a ceramic material and has an elongate shape curved in a circle having a radius of curvature different from that of the inner circumference of the sealing ring 42. The sealing ring 42 is pressed against the inner surfaces of the inner walls 11 of the ceramic nozzle segments 8 by the resilience of the ceramic spring 43. Thus, the inner circumference of the turbine nozzle 7 consisting of the plurality of ceramic nozzle segments 8 is covered closely by the sealing ring 42 divided into the circular segments.

In this support structure, the flange 20 of each nozzle segment 8 is pressed against the pressure bearing plate 40 of the nozzle support 27 by a pressure produced by multiplying the resilient force of the spring 32 by the force-multiplying mechanism 30 by the fulcrum part 31*b* of the pressing member 31. Thus, the nozzle segments 8 are supported so as to be movable in directions along the axis P. The force-multiplying mechanism 30 works on the basis of the principle of a lever. The force-multiplying mechanism 30 multiplies the resilient force of the spring 32 by the ratio L1/L2, where L1 is the distance between the point of action of the resilient force of the spring 32 on the spring holding part 31*a* of the pressing member 31 and the fulcrum part 31*b*, and L2 is the distance between the fulcrum part 31*b* and the pressing part 31*c*. For example, the ratio L1/L2=5, and the resilient force of the spring 32 is 24 kgf in this embodiment, and hence the pressing part 31*c* of the pressing member 31 of the force-multiplying mechanism presses the flange 20 against the pressure bearing plate 40 by a pressure of 120 kgf.

Therefore, even though this support structure includes the small springs that can be placed in a narrow space, the support structure is able to press the turbine nozzle 7 firmly against the nozzle support 27 to support the turbine nozzle 7 stably so that the turbine nozzle 7 may not be vibrated against exciting forces originating from the vibration of the peripheral parts and the vibration generated by the revolving flow of the combustion gas G or against exciting forces originating from currents generated by the turbine blades. Since the nozzle segments 8 of the turbine nozzle 7 are formed of the ceramic material excellent in heat resistance, the gas turbine 1 can use a high turbine inlet temperature, can operate at high efficiency, prevents environmental pollution and has extended effective life. Since the difference in thermal expansion between the ceramic turbine nozzle 7 and the adjacent metal support members including the pressing members 31, the fulcrum supporting member 33 and the nozzle support 27 is absorbed by the elasticity of the springs 32, the ceramic turbine nozzle 7 is supported axially elastically, the ceramic turbine nozzle 7 is affected scarcely by the large deformation of the metal support members, and the ceramic turbine nozzle 7 is prevented from damaging due to the unconformity of its deformation with that of the metal support members.

Since the turbine nozzle 7 is of split segment construction consisting of the circumferentially arranged individual nozzle segments 8, the turbine nozzle 7 can be employed in medium or large gas turbines in which the use of a monolithic turbine nozzle is difficult due to problems related with thermal stress and manufacturing techniques. Since the force-multiplying mechanisms are combined with the nozzle segments 8, respectively, the flange 20 of each nozzle segment 8 can be firmly pressed against the nozzle support 27 by high pressure and the turbine nozzle 7 can be uniformly supported.

The plurality of nozzle segments 8 are positioned with respect to the circumferential direction by engaging the flanges 20 of the nozzle segments 8 respectively in the recesses 37*b* of the adapter 37 as shown in FIG. 2. Therefore, nozzle segments 8 can individually move in directions parallel to the axis P of the gas turbine 1 along which the combustion gas G flows, while the turbine nozzle 7 is kept always in a desired shape. Consequently, the difference in thermal expansion between the nozzle segments 8 and the adjacent metal support members can be absorbed by the movement of the nozzle segments 8 in directions parallel to the axis P.

In each force-multiplying mechanism, the fulcrum part 31*b* having the spheroidal surface is in point contact with the bottom of the groove 33*b* having the shape of a part of a concave cylinder. Thus, the area of contact between the fulcrum part 31*b* and the bottom surface of the groove 33*b* is greater than the area of point contact between a simple spherical surface and a plane, and the degree of freedom of motion of the fulcrum part 31*b* relative to the fulcrum supporting member 33 is larger than that of members in line-contact with each other. Therefore, the fulcrum part 31*b* is able to move smoothly on the bearing part of the fulcrum supporting member 33, the resilient force of the spring 32 can be effectively and surely transmitted to the corresponding nozzle segment 8 by the turning motion of the pressing member 31. Even if the pressing member 31 and the fulcrum supporting member 33 are manufactured in a low machining accuracy and are assembled in a low assembling accuracy, the fulcrum part 31*b* of the slightly tilted pressing member 31 can be set satisfactorily in contact with the bottom surface of the groove 33*b* of the fulcrum supporting member 33. If the fulcrum part 31*b* places a large load on the bottom surface of the groove 33*b* and the fulcrum part 31*b* is deformed elastically, touch area increases and the load can be satisfactorily transmitted.

Since the pressing part 31*c* of the pressing member 31 is in line contact and not in surface contact with the flange 20 of the nozzle segment 8, the pressing part 31*c* will not come into partial contact at the edges with the flange 20 and the point of action of force will not be dislocated, and the nozzle segments 8 forming the turbine nozzle 7 can be stably pressed against the nozzle support 27. Since the cylindrical pressing part 31*c* is in line contact with the flat flange 20, the position where the pressing part 31*c* is in contact with the flange 20 changes scarcely even if the pressing member 31 is tilted with respect to a longitudinal direction and hence the turbine nozzle 7 can be stably supported.

The nozzle support 27 is provided with air inlet passages 27*c* and air passages 27*d* communicating with the interiors of the spring holding parts 31*a* by means of the air passages 37*e* of the adapter 37. Part of the compressed air A supplied from the compressor 2 shown in FIG. 1 into the wheel chamber 17 flows through the air inlet passages 27*c* and the air passages 27*d* and the air passages 37*e* into the spring holding parts 31*a* of the pressing member 31, and flows further through the four air outlets 31*d* of each spring holding part 31*a* into the gap between each pressing members 31 and each fulcrum supporting members 33. Therefore, the pressing members 31, the springs 32 and the fulcrum supporting members 33, which are formed of metals, of the force-multiplying mechanisms 30 can be effectively cooled by the compressed air A even if the ceramic nozzle segments 8 of the turbine nozzle 7 permit the use of high turbine inlet temperature.

Since the force-multiplying mechanisms 30 are isolated from the turbine nozzle 7 by the heat insulating plate 39, transfer of heat of the high-temperature turbine nozzle 7 by thermal radiation to the pressing members 31, the springs 32 and the fulcrum supporting members 33, which are formed of metals, of the force-multiplying mechanisms 30 can be effectively prevented.

The fulcrum part 31*b* of the pressing member 31 may be provided with a cylindrical groove, and the bearing parts 33*b* of the fulcrum supporting member 33 may be a protrusion having a spheroidal surface. The flange 20 of the nozzle segment 8 may be provided with a cylindrical protrusion, and the pressing part 31*c* of the pressing member 31 may be flat.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A turbine nozzle support structure for supporting a ceramic turbine nozzle disposed at inlet of a turbine on a nozzle support, comprising:

a radially protruding flange formed on the turbine nozzle; and a force-multiplying mechanism configured to press the flange against the nozzle support, the force-multiplying mechanism including a pressing member having a spring holding part, a fulcrum part and a pressing part, a spring for applying resilient force to the spring holding part, and a fulcrum supporting member having a bearing part for supporting the fulcrum part.

2. The turbine nozzle support structure according to claim 1, wherein the turbine nozzle is divided circumferentially into a plurality of nozzle segments, and each of the nozzle segments is provided with the force-multiplying mechanism.

3. The turbine nozzle support structure according to claim 2, wherein an adapter is attached to the nozzle support, the adapter being provided with positioning cuts for determining circumferential positions of the nozzle segments by engaging with the flanges of the nozzle segments.

4. The turbine nozzle support structure according to claim 1, wherein either the fulcrum part of the pressing member or the bearing part of the fulcrum supporting member has a spheroidal surface, and the fulcrum part of the pressing member and the bearing part of the fulcrum supporting member are in point-contact with each other.

5. The turbine nozzle support structure according to claim 1, wherein the pressing member is in line contact with the flange of the turbine nozzle.

6. The turbine nozzle support structure according to claim 1, wherein the nozzle support is provided with an air passage for guiding compressed air supplied from a compressor of the gas turbine to the force-multiplying mechanism.

7. The turbine nozzle support structure according to claim 1, wherein a heat insulator is interposed between the force-multiplying mechanism and the turbine nozzle.

* * * * *